US005907138A

United States Patent [19]

Metzler

[11] Patent Number: 5,907,138

[45] Date of Patent: May 25, 1999

[54] MULTI-STEP PUSHBUTTON SWITCH FOR ELECTRONIC DEVICES

[75] Inventor: Kai Juergen Metzler, Weilmuenster, Germany

[73] Assignee: Leica Camera AG, Wetzlar, Germany

[21] Appl. No.: 08/906,153

[22] Filed: Aug. 5, 1997

[30] Foreign Application Priority Data

Aug. 13, 1996 [DE] Germany ..... 196 32 525

[51] Int. Cl.[6] ..... H01H 13/00

[52] U.S. Cl. ..... 200/1 B; 200/521

[58] Field of Search ..... 200/1 R, 1 B, 200/5 R, 5 A, 16 R–16 D, 17 R, 18, 520, 521, 530–537, 540–542, 341

[56] References Cited

U.S. PATENT DOCUMENTS

| | | | |
|---|---|---|---|
| 2,948,832 | 8/1960 | Hollins | 315/82 |
| 3,431,371 | 3/1969 | Stoi et al. | 200/16 |
| 3,882,056 | 5/1975 | Nakasone | 200/16 C |
| 3,918,069 | 11/1975 | Urano | 354/23 R |
| 4,316,065 | 2/1982 | Rupp et al. | 200/61.89 |
| 4,329,039 | 5/1982 | Kaneko | 354/266 |
| 5,313,027 | 5/1994 | Inoue et al. | 200/5 A |

FOREIGN PATENT DOCUMENTS

| | | | |
|---|---|---|---|
| 43 04 304 | 9/1993 | Germany | H01H 13/64 |

*Primary Examiner*—Michael A. Friedhofer
*Attorney, Agent, or Firm*—Foley & Lardner

[57] ABSTRACT

A pushbutton switch is disclosed which may be used, for example, in a camera. The switch has multiple positions which can be easily sensed by the operator as a point of resistance which is felt at each position. The switch may have an axially moveable spring biased switching rod at a defined electrical potential with an insulated region. A plurality of spring biased electrical contacts bear radially against the switching rod. A plurality of spring biased stops extending radially toward the path of axial movement of the switching rod correspond to the respective electrical contacts. Axial movement of the switching rod brings the contacts into successive contact with the conducting portion of the switching rod. The spring biased stops bear against the end of the switching rod at approximately the points of axial movement at which their corresponding contacts make contact with the conducting portion of the swiching rod, thereby generating a counterpressure which may be sensed by an operator of the switch. The stops may be deflected from the path of axial movement of the switching rod through axial movement of the switching rod, allowing the successive switch positions to be attained.

15 Claims, 3 Drawing Sheets

MULTI-STEP PUSHBUTTON SWITCH FOR ELECTRONIC DEVICES

BACKGROUND OF THE INVENTION

The invention pertains to the field of multi-step pushbutton switches for electronic devices. The invention addresses the problem of providing a pushbutton switch which has multiple switch positions which can be reliably sensed by an operator of the switch.

A "pushbutton switch" is conventionally understood in the field to describe a switching mechanism which employs a button or similar structure which is depressed to select among successive switch positions. A pushbutton switch having more than one switch position is known as a multistep switch.

In multistep switches, it is conventional to provide structure in the switch which allows the individual operating the switch to distinguish among the successive switch positions by means of a counterpressure which increases with successive switch positions. For example, in a pushbutton switch having first, second and third switch positions, three successive counterpressures may correspond to the three switch positions. The first position may be sensed as a first counterpressure having a first magnitude generated by a "stop". The button may thereafter be further depressed to attain a second switch position. Upon attaining the second position, a second counterpressure of a second magnitude which is greater than that of the first counterpressure will be sensed. By applying still further pressure, the third position may be attained. A third counterpressure of a third magnitude which is greater than that of the second counterpressure will be sensed when the third switch position is attained. Typically, where the selected position corresponds to depression of the switch to its maximum depth, the counterpressure is generated by a "fixed stop" which obstructs further depression of the button.

Pushbutton switches of the type described above are found, for example, in cameras having electronic control systems. The various switch positions may typically correspond to modes of operation of the camera. For example, when the switch is depressed to the first position, the camera may respond by measuring the light level and focal distance of a subject to be photographed. Further depression of the switch to the second position may then cause the camera to photograph the subject in accordance with the measurements previously taken.

Two conventional multistep pushbutton switches are known. The first conventional switch uses a switching rod which may be depressed against the force of a restoring spring. Two bolts extend from the switching rod in the axial direction of the switching rod. The degree of extension of each bolt is adjustable. The switching rod and the bolts extend toward two spring biased electrical contacts which correspond to the bolts. As the switching rod is depressed, a first bolt will make contact with its corresponding spring biased electrical contact. This contact may, for example, connect the bolt to ground potential. When this contact is made the switch has attained the first position. The operator will sense the increased counterpressure generated by the spring biased electrical contact and will recognize that the switch is in the first position. At a certain point of further depression the second bolt will make contact with its corresponding spring biased electrical contact. When the second bolt makes contact, the switch attains the second position. The operator will sense the increased counterpressure generated by both spring biased electrical contacts and will recognize that the switch is in the second position.

In pushbutton switches of the type described above, the counterpressures corresponding to each switch position must be differentiable to the operator from the friction forces of the switching rod and the counterpressure generated by the restoring spring. In practice, it has been found that the counterpressure generated by the second electrical contact is often sensed only weakly by the operator. Therefore it is generally not possible to indicate more than two switch positions by means of cumulative counterpressures. If a further switch position is desired to be provided, this is conventionally done by providing a slide contact on the switching rod which makes contact with an associated electrical contact at approximately the point at which further movement of the switching rod is prevented through contact with a fixed end stop. Accordingly, the operator is not able to precisely sense the point at which the third switching state is attained.

Pushbutton switches of the above type present difficulties in installation and use. The design of the switching rod is complex, and the bolts and their associated contacts must be precisely positioned in order for the switch to operate properly. In addition, all of the individual parts of this type of switch must be installed separately and then aligned. This makes both installation and repair a time consuming and complex procedure.

The pushbutton switch disclosed in German Patent Application DE 43 04 304 A1 is representative of the second conventional type of pushbutton switch. This type of switch employs a switching rod that is depressed to make contact with a cantilevered dome-shaped diaphragm. The diaphragm is positioned with its face adjacent a circuit board to which is mounted an annular switching contact and a central contact located within the anular contact. When the switching rod is pressed down against the dome-shaped diaphragm, the edge of the dome-shaped diaphragm initially makes contact with the annular switching contact, thereby achieving a first position and producing an increased counterpressure which can be sensed by the operator. If further pressure is applied, the dome of the diaphragm flexes inward and contacts the central contact. Contact with the central contact achieves a second switch position and can be sensed by the operator as a fixed stop. Switches of this type are of limited use in that it is not possible to provide more than two switch positions.

SUMMARY OF THE INVENTION

It is an object of invention to provide a multistep pushbutton switch which overcomes the limitations of conventional pushbutton switches by providing multiple switch positions which can be reliably sensed and by providing a compact and service-friendly design.

It is a further object of the invention to provide a pushbutton switch having multiple switch positions which eliminates the use of cumulative counterpressures for indicating successive switch positions.

In a preferred embodiment of the invention, electrical contacts are successively placed at the potential of a switching rod through displacement of the switching rod in the direction of mechanical stops associated with the electrical contacts. The contact tips are arranged to extend radially relative to the axis of the switching rod, thus allowing finely graduated positioning of the contact tips without the need for excessive miniaturization. Accordingly, a switch with little overall height and short switching paths may be achieved. In operation, the front end of the switching rod comes successively to bear against stops which correspond to the electrical contact tips and, upon further depression, deflects them outward from its path of movement. When each stop has been deflected completely out of the path of movement, the switching rod is free to continue axial movement against the resistance of only a restoring spring and the frictional force acting on the switching rod. Accordingly, each switch position is sensed as a point of resistance which is easily differentiable from the counterpressure of the restoring spring and associated frictional forces. Each stop may be adjusted to provide a degree of resistance which is appropriate to counteract the force imparted by the operator to overcome an immediately preceding stop. The switching rod is provided with a conical beveled end portion for engaging and deflecting complementary conical mechanical stops. By coordinating the bevel of the switching rod and the radius of the conical stops, both the overall height of the pushbutton switch and its operation may be optimized. The pushbutton switch may therefore be provided as a unitary component which can be tested and adjusted outside of the device of its application. In the event of a component failure, easy replacement is enabled.

Accordingly, the invention may be provided as a multistep pushbutton switch which includes a switching rod having a conducting portion and an insulated portion and being axially moveable along a path of axial motion, a first electrical contact contacting said switching rod, and a first stop biased to extend inward toward said path of axial movement. The first stop is deflectable outward from the path of axial movement through engagement with the switching rod during axial movement thereof, and the first stop is axially positioned with respect to the electrical contact tip such that engagement of the first stop with the switching rod during axial movement thereof corresponds to a transition of the first electrical contact from contact with the insulating portion to contact with the conducting portion.

The invention may be further provided to include a second electrical contact contacting the switching rod and a second stop biased to extend inward toward the path of axial movement, with the second contact and stop bearing the same relationship as the first contact and stop.

The invention may therefore also be provided as above and having a plurality of contacts and stops bearing the aforementioned relationship.

BRIEF DESCRIPTION OF THE DRAWINGS

The present invention may be fully understood through reference to the detailed description which follows below to the associated drawings, in which.

DETAILED DESCRIPTION OF PREFERRED EMBODIMENTS

Figure 1:
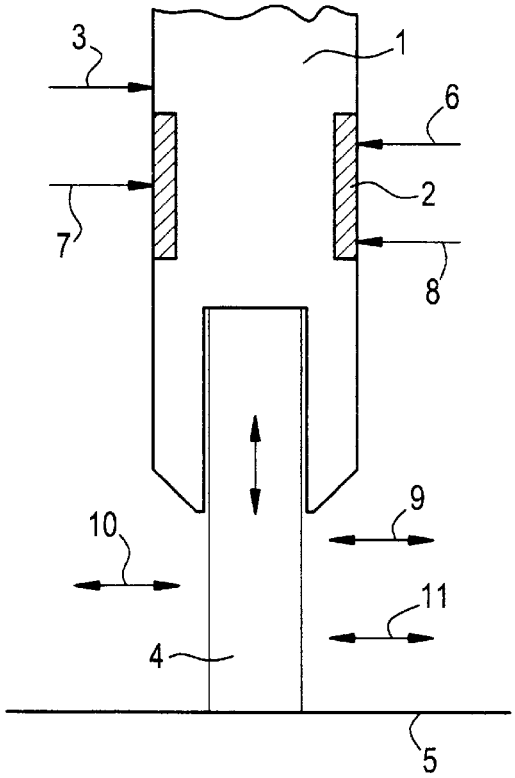
FIGS. 1 and 2 illustrate the basic design and manner of operation of the invention.
Figure 2:
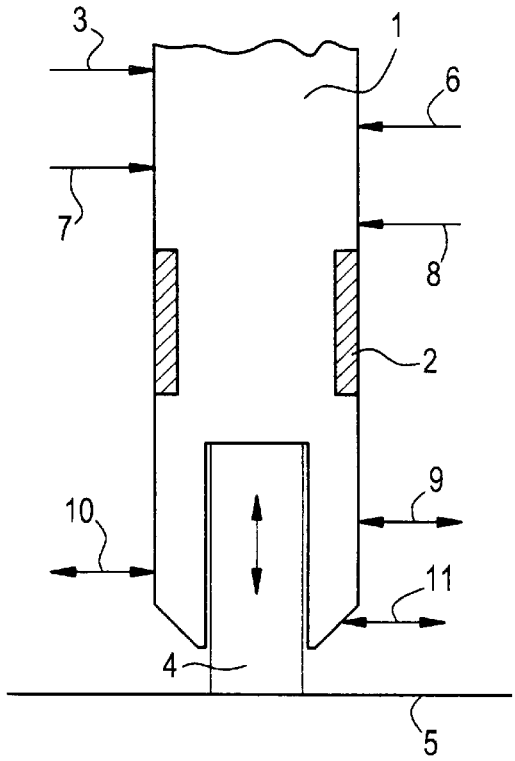

The basic design and manner of operation of the invention may be understood through reference to the embodiment illustrated in FIGS. 1 and 2. The embodiment of FIG. 1 includes a conducting switching rod 1 having an electrical potential which is supplied via an electrical contact 3 and which is chosen relative to a ground potential selected in a conventional manner. The electrical contact 3 is spring biased. The switching rod 1 further has an electrically insulating annular region 2. The switching rod 1 is biased toward an extended position by a restoring spring 4 which is supported on an end stop 5. The switching rod 1 has a conical beveled lower end.

Three further spring biased electrical contacts 6, 7, 8 bear against the insulating region. The contacts are located at successive axial positions along the switching rod.

Three spring biased stops 9, 10, 11 project radially toward the path of axial motion of the switching rod 1. The spring biased stops 9, 10, 11 are provided at successive axial positions which correspond to the axial positions of the spring biased electrical contacts and which will be successively deflected by the beveled lower end of the switching rod 1 when the switching rod 1 is moved in an axial direction against the force of the restoring spring 4. The axial position of the first stop 9 is selected such that, when the switching rod 1 bears against this stop, the contact 6 has left the insulating region 2 and is in contact with the conducting portion of the switching rod 1. Accordingly, an operator of the switch who has depressed the switching rod 1 to contact the first stop 9 will sense counterpressure generated by the first stop 9 indicating that the switch has been depressed to the first position.

FIG. 2 shows the embodiment of FIG. 1 wherein the switching rod 1 has been depressed so as to bear against the third stop 11. It may be seen that each of contacts 6, 7, 8 bear against the conducting portion of the switching rod and are thus in electrical contact therewith. The switch is thus in a third switch position.

It may be further seen in FIG. 2 that the stops 9 and 10 have been deflected from their former positions of axial extension so as to be completely removed from the path of axial movement of the switching rod 1, and that the beveled end of the switching rod 1 bears against the third stop 11. It will be appreciated that as each switched position is attained, the operator will sense the counterpressure generated by the bearing of the beveled end against the corresponding stop, and that as each stop is traversed, the counterpressure sensed by the operator returns to a minimum counterpressure generated by the restoring spring and any frictional forces associated with movement of the switching rod. Thus, when the switching rod 1 has been depressed sufficiently to attain the third switched position illustrated in FIG. 2, the operator will have sensed and traversed the counterpressures generated by stops 9 and 10, and will sense the counterpressure generated by stop 11. The operator may further depress the switching rod 1 until the beveled end makes contact with the fixed end stop 5, thus indicating to the operator that the last switch position has been attained. It is noted that in some applications it is therefore possible to dispense with the last stop where contact with the fixed stop will provide suitable indication of the switch position. It is further noted that it may be desirable in some application to adjust the bias of each stop to provide a degree of resistance which is appropriate to counteract the force imparted by the operator to overcome an immediately preceding stop.

From FIGS. 1 and 2 it will be apparent that further contact tips and stops beyond the three illustrated switched positions may be provided. The relatively gentle sloping of the beveled end of the switching rod and the radially offset arrangement of the contact tips and stops around the switching rod allow for a multistep switch which is not limited in the number of switch positions and which has a compact design with short switching paths.

Figure 3:
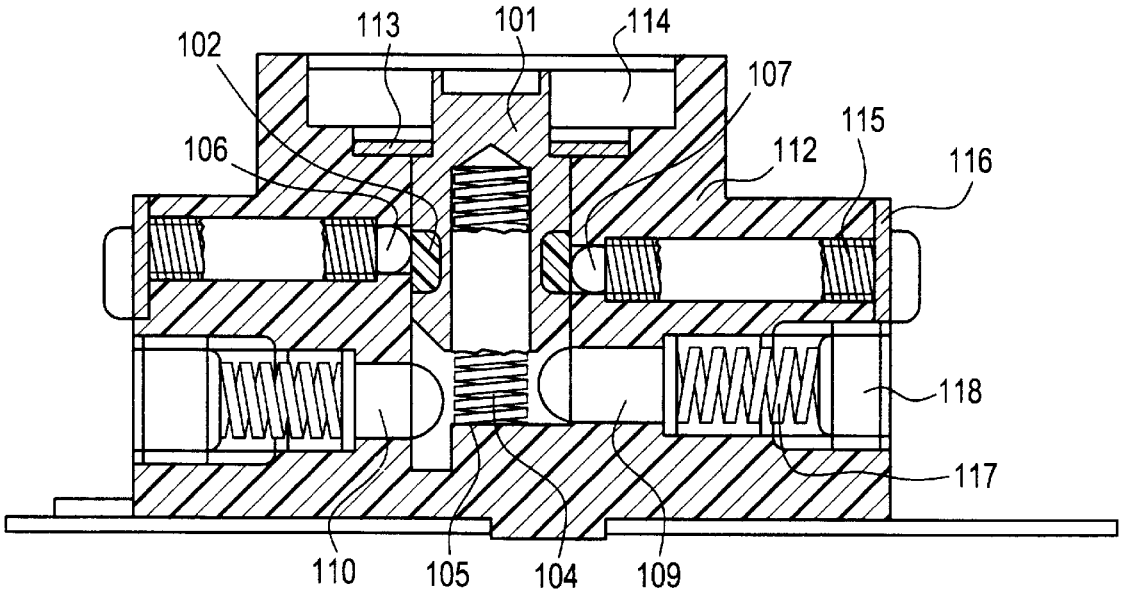
FIG. 3 shows a cross-section of an exemplary embodiment in a home position.

FIGS. 3 through 6 illustrate a preferred embodiment of a multistep pushbutton switch in accordance with the invention. As seen in FIG. 3, a switching rod 101 is slidably mounted within a casing 112 so as to be capable of axial displacement against the force of a restoring spring 104. The casing may be made, for example, of nonconductive plastic. The casing 112 has an upper stop 113 for limiting the range of motion of the switching rod 101. The upper end of the switching rod 101 lies in a depression in the casing 112 which protects against mechanical damage to the switching rod 101 when the pushbutton switch is being installed in a device, and which makes positioning of the switch within a device a less delicate operation. The restoring spring 104 is supported on a lower stop 105 and biases the switching rod 101 against the stop 113.

The switching rod 101 has an electrically insulating region 102 against which electrical contacts 106, 107, and 108 bear. In the illustrated embodiment, the contact 108 lies in the section of the switch which is radially offset by 90° from the plane of the cross section and so is not visible in FIGS. 3, 4 or 5. A cross section illustrating contact tip 108 and analogously positioned elements is illustrated in FIG. 6.

The electrical contacts 106, 107, and 108 each comprise a metallic ball which is located in a cylindrical aperture in the casing 112 and which is biased against the switching rod 101 by a metallic spring 115. The opposite end of each spring 115 bears against a solder lug 116 which seals the cylindrical aperture and provides electrical contact with the metallic ball.

Figure 4:
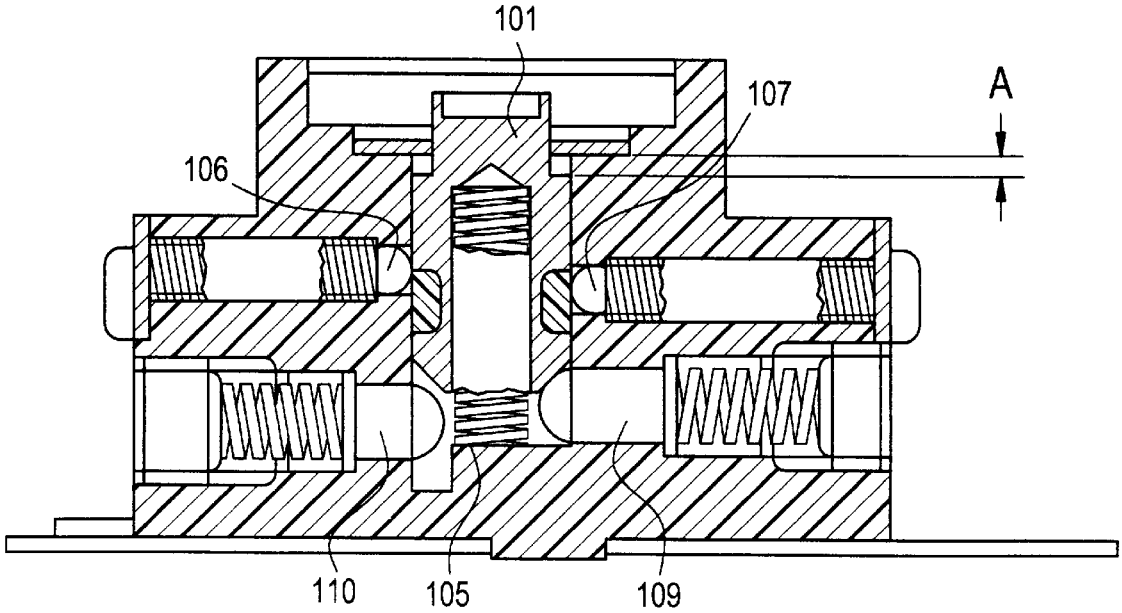
FIG. 4 shows the embodiment of FIG. 3 in a first switch position.

FIG. 4 shows the embodiment of FIG. 3 in which the switching rod 101 has been axially depressed a distance A toward the lower stop 105. In this position the contact 106 bears against the conducting portion of the switching rod 101 and the beveled end of the switching rod bears against the corresponding mechanical stop 109. Stop 110 remains uncontacted by the switching rod 101. Each stop 109, 110 comprises a cylindrical pin with a spherical cap and a face with a relatively large diameter. Each cylindrical pin extends outward from a radial aperture within which it is slidably disposed. A shoulder in each radial aperture limits the radially inward extension of each cylindrical pin. A spring 117, which is supported at the outward end of the radial aperture by a screw 118, biases each cylindrical pin radially inward. The biasing force provided by the spring 117 may be adjusted by turning the screw 118.

Figure 5:
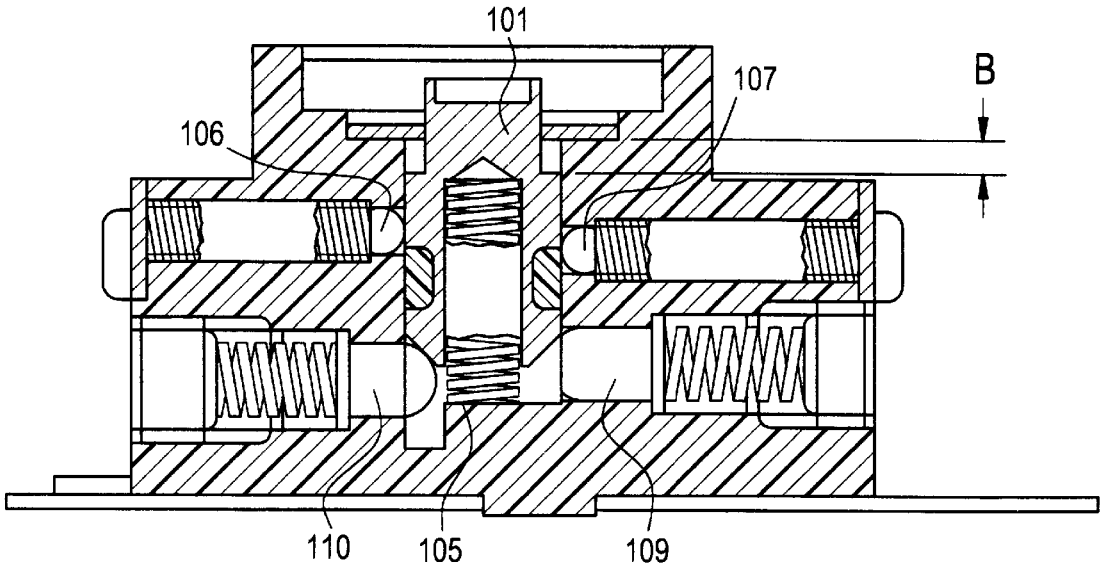
FIG. 5 shows the embodiment of FIG. 3 in a second switch position.
Figure 6:
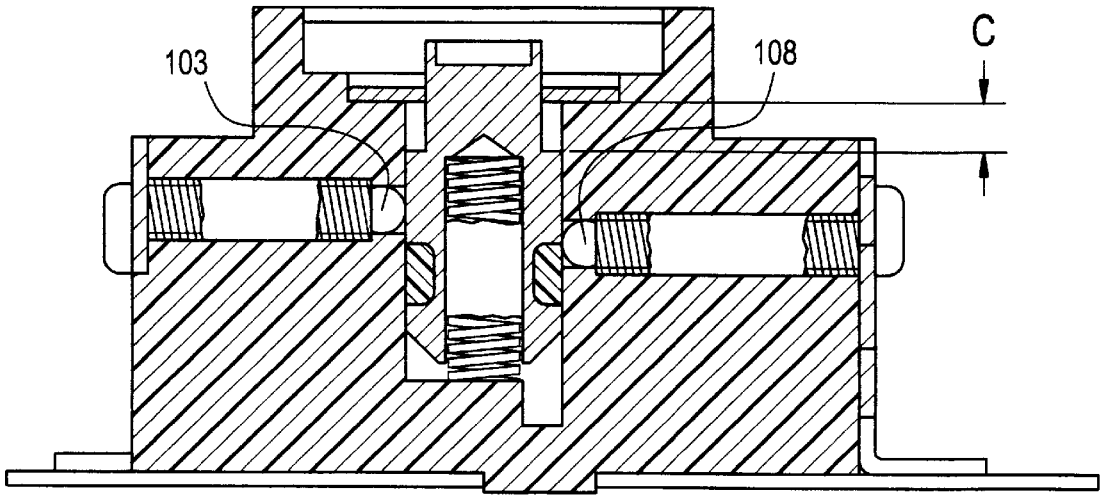
FIG. 6 shows the embodiment of FIG. 3 in a third switch position.

FIG. 5 shows the embodiment of FIGS. 3 and 4 wherein the switching rod 101 has been further displaced from its original position by a distance B toward the end stop 105. The beveled end of the switching rod 101 has deflected the stop 109 radially outward and into its radial aperture and bears against the next successive stop 110. It will be appreciated that, as in the embodiment of FIGS. 1 and 2, the operator of the switch, in depressing the switching rod 101 to the illustrated position, will have sensed the release of the counterpressure generated by cylindrial member 109 which will have occurred when cylindrical member 109 is fully deflected to within its radial aperture by the switching rod 101, indicating that the first switched position has been surpassed. The operator will further sense the succesive counterpressure generated by the next successive cylindrical member 110, indicating that the switch has attained the second switched position.

It may be further seen in FIG. 5 that the insulated region 102 has moved out of contact with contact 107, thus placing contact 107 in electrical contact with conducting switching rod 101.

FIG. 6 provides a view which is rotated by 90° with respect to the plane of sectioninal views of FIGS. 3 to 5. In FIG. 6, the switching rod 101 has been further axially displaced from its original position by a distance C, thus providing electrical contact with contact 108. It may be further seen that the end of switching rod 101 is in contact with fixed end stop 105, thus providing an additional indication to the operator that the final switch position has been attained.

Through comparison of the electrical contact positions with respect to the switching rod as illustrated in FIGS. 3–6, it will be appreciated that by providing a radial offset between electrical contacts, the position of each contact may be determined soley with respect to the needs of the particular application and without obstruction by other contacts. The stops may be similarly radially offset to provide a similar advantage.

It will further be appreciated that it may be desirable for some applications to provide successively higher biasing forces for successive stops. Stops biased in this manner will assist in preventing a user from traversing more than one stop through the application of fingerpressure which is intended to traverse only a single stop.

It will also be appreciated that modifications may be made to the above preferred embodiments in accordance with the needs of particular applications which do not affect the basic goals and operation of the invention. For example, while the specific embodiments utilize a conducting switching rod with an insulating portion, it will be appreciated that an insulating rod with a conducting portion could be equivalently employed. In such embodiments, switching would occur upon an electrical contact being removed from contact with the conducting member.

Thus, from the foregoing it will be appreciated that the invention overcomes the disadvantages of conventional pushbutton switches. It will be further appreciated that the description provided above will enable those having ordinary skill in the art to produce alternative embodiments through the use of structures and designs which are the substantial equivalent of those described herein.

The entiryety of German patent application 196 32 525.0 34, from which priority is claimed, is incorporated herein by reference.

What is claimed is:

1. A pushbutton switch, comprising:

a switching rod having a conducting portion and an insulated portion and being axially moveable along a path of axial movement;

a first electrical contact contacting said switching rod; and a first stop biased to extend inward toward said path of axial movement, said first stop being deflectable outward from said path of axial movement through engagement with said switching rod during axial movement thereof, said first stop being axially positioned with respect to said first electrical contact such that engagement of said first stop with said switching rod during axial movement thereof corresponds to a transition of said first electrical contact between contact with said insulating portion and contact with said conducting portion.

2. The switch of claim 1, further comprising:

a second electrical contact contacting said switching rod; and a second stop biased to extend inward toward said path of axial movement, said second stop being deflectable outward from said path of axial movement through engagement with said switching rod during axial movement thereof, said second stop being axially positioned with respect to said second electrical contact such that engagement of said second stop with said switching rod during axial movement thereof corresponds to a transition of said second electrical contact from contact with said insulating portion to contact with said conducting portion.

3. The apparatus of claim 1, wherein said switching rod comprises a conical beveled end portion.

4. The apparatus of claim 1, wherein said first electrical contact comprises a spring biased member extending radially inward toward said switching rod and having a rounded contact tip.

5. The apparatus of claim 1, wherein said first mechanical stop comprises a spring biased member extending radially inward toward said path of axial movement of said switching rod and having a tip shaped to produce radially outward deflection of said member upon engagement with a beveled end of said switching rod during axial movement of said switching rod.

6. The apparatus of claim 5, wherein a biasing force of a biasing spring associated with said stop is adjustable in magnitude.

7. The apparatus of claim 1, wherein said conducting portion is at ground potential.

8. A multistep pushbutton switch, comprising:

a switching rod having a conducting portion and an insulated portion and being axially moveable along a path of axial movement;

a first electrical contact radially biased toward said switching rod and contacting said switching rod;

a first stop biased to extend inward toward said path of axial movement, said first stop being deflectable outward from said path of axial movement through engagement with said switching rod during axial movement thereof, said first stop being axially positioned with respect to said first electrical contact such that engagement of said first stop with said switching rod during axial movement thereof corresponds to a transition of said first electrical contact between contact with said insulating portion and contact with said conducting portion;

a second electrical contact radially biased toward said switching rod and contacting said switching rod; and a second stop biased to extend inward toward said path of axial movement, said second stop being deflectable outward from said path of axial movement through engagement with said switching rod during axial movement thereof, said second stop being axially positioned with respect to said second electrical contact such that engagement of said second stop with said switching rod during axial movement thereof corresponds to a transition of said second electrical contact between contact with said insulating portion and contact with said conducting portion.

9. The switch of claim 8, wherein said first electrical contact and said second electrical contact are radially offset.

10. The apparatus of claim 8, wherein said first stop and said second stop are radially offset.

11. The apparatus of claim 8, wherein said second stop is biased to extend inward by a biasing force which is greater than a biasing force by which said first stop is biased to extend inward.

12. The apparatus of claim 8, further comprising:

a fixed stop for limiting a range of axial movement of said switching rod.

13. A multistep pushbutton switch, comprising:

a switching rod having a conducting portion and an insulated portion and being axially moveable along a path of axial movement;

a plurality of electrical contacts radially biased toward said switching rod and contacting said switching rod at successive positions relative to said path of axial movement; and a plurality of stops biased to extend radially inward toward said path of axial movement at successive positions relative to said path of axial movement, each of said stops being deflectable outward from said path of axial movement through engagement with said switching rod during axial movement thereof, each of said stops being axially positioned with respect to a corresponding one of said electrical contacts such that engagement of said each of said stops with said switching rod during axial movement thereof corresponds to a transition of a corresponding electrical contact of said contacts between contact with said insulating portion and contact with said conducting portion.

14. A multistep pushbutton switch, comprising:

a switching rod axially moveable along a path of axial movement; and a plurality of stops biased to extend radially inward toward said path of axial movement at successive positions relative to said path of axial movement, each of said stops being deflectable outward from said path of axial movement through engagement with said switching rod during axial movement thereof, deflection of each of said stops corresponding to a transition of a corresponding electrical contact between an open switch state and a closed switch state.

15. A camera, comprising:

electronic means for controlling functions of said camera; and a switch coupled to said electronic means for selecting functions of said camera, said switch comprising a switching rod axially moveable along a path of axial movement, and a plurality of stops biased to extend radially inward toward said path of axial movement at successive positions relative to said path of axial movement, each of said stops being deflectable outward from said path of axial movement through engagement with said switching rod during axial movement thereof, deflection of each of said stops corresponding to a transition of a corresponding electrical contact between an open switch state and a closed switch state.

* * * * *